United States Patent [19]

Parker et al.

[11] Patent Number: 4,902,364

[45] Date of Patent: Feb. 20, 1990

[54] HEAT TRANSFER DECORATIONS WITH PATTERNED METALLIZATION

[75] Inventors: Tim Parker, Shrewsbury, Mass.; Dennis R. Benoit, Woonsocket, R.I.

[73] Assignee: Dennison Manufacturing Company, Framingham, Mass.

[21] Appl. No.: 227,217

[22] Filed: Aug. 2, 1988

[51] Int. Cl.[4] ..... B44C 1/165

[52] U.S. Cl. ..... 156/233; 156/234; 156/241; 427/145.7; 427/145; 427/146; 427/147; 428/209; 428/913

[58] Field of Search ..... 428/209, 913, 914; 427/145.7; 156/233, 234, 241

[56] References Cited

U.S. PATENT DOCUMENTS

| | | | |
|---|---|---|---|
| 3,463,651 | 8/1969 | Warsager | 428/200 |
| 3,480,500 | 11/1969 | Hotter | 156/233 |
| 4,012,552 | 3/1977 | Watts | 428/200 |
| 4,101,698 | 7/1978 | Dunning et al. | 428/31 |
| 4,313,994 | 2/1982 | Kingston | 428/200 |
| 4,477,312 | 10/1984 | Czichy | 156/656 |

FOREIGN PATENT DOCUMENTS 0073731 6/1980 Japan .

*Primary Examiner*—Ellis P. Robinson
*Assistant Examiner*—P. J. Ryan
*Attorney, Agent, or Firm*—Barry D. Josephs; Arthur B. Moore

[57] ABSTRACT

A metallized laminate and process of manufacture wherein a metallic layer or underlying ink layer appears in a pattern on the laminate. The method in a specific embodiment involves the steps of forming a laminate by coating a heat stable release coat onto a carrier sheet; coating an ink layer in a pattern on the heat stable release coating so that at least portions of the release coat remain uncovered with ink, and applying a metallic layer over the release coat so that at least a portion of the metallic layer is in direct contact with and adheres directly to the release coat. Portions of the metallic layer may be removed by an etchant. A heat activatable adhesive layer is applied over the metallic layer. The laminate so formed is heat transferable from the carrier sheet to an article.

8 Claims, 1 Drawing Sheet

HEAT TRANSFER DECORATIONS WITH PATTERNED METALLIZATION

BACKGROUND OF THE INVENTION

This invention relates to heat transfer metallization and more particularly, to heat transfer decorations with patterned metallization.

Patterned metallization can be achieved by removing portions selectively of a metallized web. One procedure is to use sodium hydroxide caustic to selectively remove vacuum-deposited aluminum.

Thus, in U.S. Pat. No. 4,685,997 a patterned laminate is formed by printing an etchant image on a metallized web. The etchant dissolves the metallized surface in the printed areas to provide the desired pattern. Variants of the procedure are found in U.S. Pat. No. 4,610,755 and 4,552,614. In 4,610,755 a water-based varnish with a dissolved etchant is printed on a metallized surface. In 4,552,614 an aqueous etchant is sprayed on the metallized surface.

Another variant is disclosed in U.S. Pat. No. 4,517,045, U.S. Pat. No. 4,398,994 and Canadian 1,141,273. A pattern is formed on an aluminized polymer film by printing with sodium hydroxideresistant material. The non-overprinted areas are then contacted with hot aqueous sodium hydroxide solution to dissolve the nonprinted aluminum, which is washed from the film.

The foregoing procedures cannot be used with conventional heat transfer material because the results are unsatisfactory. The metal patterns tend to become dull and molted in transfer.

In a hot stamp foil that transfers bright metal as a decoration there is typical employment of this brittle protective lacquer. These lacquers are used as in U.S. Pat. No. 4,275,116 to immobilize the metal layer. Dimensional and thermal stability of 1.5 to 4 percent elongation layer are imparted by polymester film. Application of thick backing layers other color or adhesives impart mobility and destroy metal film layer integrity.

In general there is a demand for heat transfer decorations with bright metal graphics. This cannot be achieved with the protective lacquers used for thermally transferring conventional graphics to compound curves. Lacquers which soften below 350° F. (175° C.) stretch upon heat transfer above 200° F. (100° C.) and vacuum-deposited bright metal layers turn dull. Metal layers which were restricted from breaking up by the proximity to the polyester film in standard hot-stamped foils would turn matte upon transfer to a compound curve with additional graphics and metal protection.

On the other hand, one would not expect that coatings with softening points above 350° F. (175° C.) and elongations ranging from 6 to 80 percent at thicknesses up to 25 microns could stabilize this type of multi layer construction by keeping the metal from shifting and turning dull.

Accordingly, it is an object of the invention to permit high speed heat transfer of multi-colored graphics with protected specular metal to compound curves from a carrier web.

SUMMARY OF THE INVENTION

In accomplishing the foregoing and related objects, a clear thermally stable layer is applied to a smooth dimensionally stable carrier for a decoration that is to be transferred by heat. The thermal stability extends to the temperature at which the decoration is to be transferred.

Carriers for the decoration include polyester film and paper which has been extrusion-coated, for example, with high density polyethylene. Where the decoration is to include bright metal effects, the substrate for the carrier should have a smooth surface, for example, a Sheffield smoothness of less than 100 cubic centimeters of air per square inch. It is desirable to employ a top coat with a minimum thickness of 2.5 microns. A release coated surface may also be used. The clear thermally stable layer should release from the substrate surface at 10 to 70 grams per inch at the heat transfer temperature.

The thermally stable layer may be a high temperature thermoplastic such as polyethersulfone or a thermoset epoxy butyral or urethane-acrylate. The heat stable layer inhibits movements of a vacuum-deposited metal at heat transfer temperatures, for example in the range from 200° to 500° F. The thermally stable layer can be applied to one or both sides of the metal. Standard heat transfer inks and adhesives can be employed for the balance of the construction.

The invention additionally provides a heat transfer composite or composite formed by a carrier with a metallic pattern and associated with a thermally stable layer. The thermally stable layer can be upon the metallic pattern, between the carrier and the metallic pattern or on both sides of the metallic pattern. Where the thermally stable layer is upon the metallic pattern, it can have adhesive properties as well.

The heat transfer composite is desirably thermally stable to at least 350° F. The thermally stable layer can be a high temperature thermoplastic, such as polyethersulfone. Alternatively, the thermally stable layer can be a thermoset plastic, such as epoxy butyral or urethane-acrylate or epoxy acrylate. Heat resistant thermoplastics can be modified with thermosets such as epoxies and urethanes. Applicant has observed that modification of these coatings with such thermoset materials can enhance appearance, and surprisingly, that such multilayer constructions remain stable with no significant shifting or dulling of the metal layer.

The carrier for the heat transfer composite can be polyethylene terephthalate, or paper with an extrusion coating, such as high density polyethylene or polypropylene. The carrier base desirably has a Sheffield surface smoothness that permits a flow of at least 100 cc of air per square inch per second.

The thermally stable layer advantageously releases in the range from 10 to 70 grams per inch at heat transfer temperatures, for example, in the range from 200° to 500° F. (100° to 260° C.).

In a method of providing a composite for the transfer of a metallic patterns to a surface, a carrier is provided in which a metallic pattern is stabilized by a layer which can be applied to the carrier or over the metallic pattern.

DESCRIPTION OF THE DRAWINGS

Other aspects of the invention will become apparent after considering several illustrative embodiments taken in conjunction with the drawings in which.

DETAILED DESCRIPTION

Figure 1:
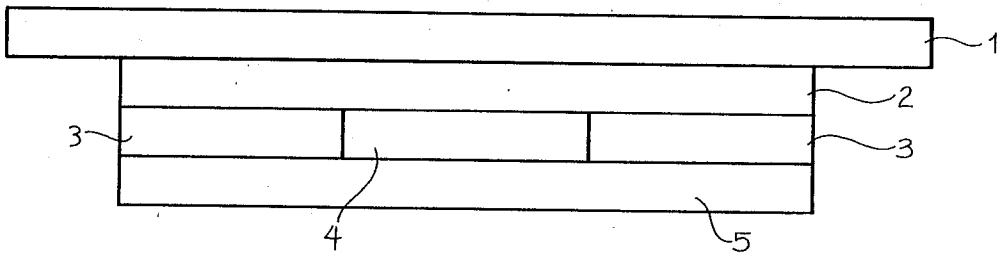
FIG. 1 is a cross-sectional view of a composite for heat transfer in accordance with the invention.
Figure 2:
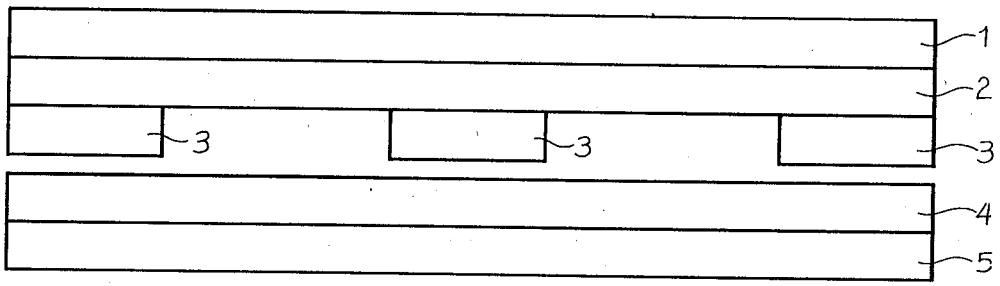
FIG. 2 is a cross-sectional view of an alternative composite for heat transfer decorations in accordance with the invention.

With respect to FIG. 1, a heat transfer composite for bright metal includes a carrier layer (1) which is dimensionally stable. A suitable carrier is polyethylene terephthalate (PET) polyester film. Alternatively, the carrier may be paper which has been extrusion-coated with high density polyethylene or polypropylene.

A release system may be applied to the carrier. A suitable release is in the form of a lacquer. Alternatively the release can be an extrusion coating on a carrier. The release also may be effected by use of a high temperature thermoplastic or a high temperature thermoset which is sufficiently incompatible with the carrier surface at transfer temperatures. A suitable high temperature thermoplastic is polyethersulfone and suitable high temperature thermosets are epoxy-butyrals, urethane acrylates, or epoxidized acrylates.

An ink layer or pattern (3) is applied to the thermally stable lacquer layer and metal (4) is vacuum-deposited on the surface of the ink. This results in a layer with alternate patterns of inking and metal. A suitable high temperature resin is polyethersulfone (PES). A standard heat transfer adhesive (5) is then applied over the composite including the high temperature resin.

Details regarding various components of the composite are set forth below:

I. CARRIER

Biaxially oriented polyethylene terephthate (PET) melts at 492° F. (256° C.) and has sufficient thermal stability for transfer. Optimum surface smoothness can be obtained from MYLAR D but specular transfers can be obtained from MYLAR Type A (Clay silica filled commodity grade). (MYLAR is the trademark of E. I. DuPont de Nemours and Company, Wilmington, Del. for PET polyester film).

II. RELEASE

PET film is usually coated and/or treated for receptivity to inks, coatings and adhesives for graphic art applications. There are a number of lacquers which can be direct printed on PET without a release coating. A very thin layer of polymethylmethacrylate (PMMA) acrylic is used as a release lacquer in hot stamp foils. A PMMA acrylic with a $T_G = 105°$ C. was used as a release coat to transfer bright metal with a thermoset acrylic adhesive crosslinked with a high molecular weight epoxy. Polyvinyldifluoride (PVDF) will release from PET when dried up to 300° F. (150° C.). When PVDF is baked on at 450° F. (230° C.), the PVDF will bond to the PET. Polyethersulfone (PES) does not soften below 440° F. (226° C.) and will heat transfer from PET with a polyamide adhesive. PES also has sufficient immobility at temperature to avoid distorting vacuum deposited aluminum.

Spot transfers of a hot stamp foil to a printed web requires a lower release than the printed web. EB cured silicone-acrylic on PET may be used as the hot stamp foil carrier. A good metallizing grade of biaxially oriented polypropylene (BOPP) without a corona treatment can produce the proper balance of release and thermal stability.

III. LACQUER

PES on one or both sides of bright aluminum combines release from PET, transparency, heat stability, and a smooth glossy surface, but lacks barrier properties to clorinated, aromatic and polar ester solvents. PVDF can be a release/barrier lacquer. Thermoset acrylic adhesives and epoxy or epoxy/butyrate have thermal stability to maintain a bright metal finish during transfer, and chemical resistance. Phenoxies soften at 212° F. (100° C.), but do not flow under 428° F. (220° C.). They are also good barriers to carbon dioxide ($CO_2$) (23 cc/mil/100 in 2/24 hrs/atms). Since they have poor adhesion to nylon, fluorocarbons (PVDF and TEDLAR PVF), PVC and polyolefins; they could be transferred from these films or coatings. (du Pont polyvinylfluoride film), Metal transfer can be acceptable without cross linking, but crosslinking can be added. Low functionality acrylics and polyether urethanes have good film forming properties with marginal adhesion to PET.

IV. INK

The typical polyamide/nitrocellulose (PA/NC) ink does not wet PVDF or acrylic lacquers, but wetting is achieved when these inks are used with the stabilizing layers of the invention, such as polyethersulfone. Most adhesion failures are cohesive in the PA/NC ink layer when wet out was obtained. The N-butyl and isobutylmethacrylate acrylic inks are acceptable, but methyl and methyl/butyl copolymer acrylate based with a $T_G$ of 50°–60° C. inks are preferred.

V. ADHESIVE

High molecular weight thermoplastic polyamides that are non-blocking, can provide specific adhesion to untreated polyolefins. They also provide better universal adhesion to metal, inks, lacquers and bottles.

EXAMPLE #1

Polyethersulfone (PES) with a heat softening point of 227° C. (444° F.) was solvated in a compatable solvent blend and adjusted to a printable viscosity. Application to a PET polyester film or high density polyethylene or polypropylene coated kraft carrier, followed by a printed ink design, vacuum deposited aluminum and then heat sealable adhesive resulted in clean transfer to thermoplastic blow molded components. Reflectivity of visible light from the transferred composite with bright metal was maintained above 85%. The stable lacquer, inks and adhesive were dried with hot air to evaporate all of the solvent vehicles after each application. The stable lacquer at a deposition rate (coating thickness) from 0.0004 to 25 micrometers maintained the bright specular metal finish after heat transfer. The lower deposition rate was adequate for rigid substrates, but marginal for flexibility upon being transferred to softer materials. A thickness of 0.0008 was found to be the minimum that would maintain the bright metal appearance with repeated flexing. The upper thickness is only limited by the transparency of the heat stable lacquer system.

EXAMPLE #2

PES was applied to a PET carrier as in Example #1 above. After metalizing to a reflectivity of greater than 85%, a PES pattern was printed on the metal as a resist. Subjecting the web to a standard flexible circuit etchant such as cupric chloride/hydrochloric acid or ammonium persulfate resulted in removal of the metal which was not protected by the second application of PES. This yielded a reflective metallized image with good edge definition only where the second layer of PES was printed. Following application of a heat activatable adhesive, the composite was transferred to a substrate with the same specular results as in Example #1. Other materials printed as resists, such as polyamide lacquers and polyvinyldichloride, instead of the second application of PES produced similar results.

EXAMPLE #3

Modification of the PES lacquer with epoxy results in a harder, more chemical resistant protective lacquer for the metal. Addition of epoxy up to equal parts on a dry weight basis with the PES was evaluated on PET. Standard epoxy catalysts such as Dicyandiamide or cyanoguanidine with terterary amine accelerators were used. At equal parts the release from the PET starts to become tight, but no problems were encountered at a PES to epoxy ratio of 60 to 40 on a dry weight basis. High molecular weight epoxies in dry flake form produced harder, drier and more flexible coatings, but liquid epoxies at 100% solids yielded similar results at the same ratios with PES. Higher epoxy content mixes can be employed on a release coated PET carrier on a polyolefin coated kraft carrier. Polymethylmethacrylate (PMMA) or Polyvinyl alcohol (PVOH) are suitable release coats for (PET). Following the same ink, metal and adhesive application sequence and techniques as in Example #1 resulted in the same highly specular heat transfer to the substrate. The addition of epoxy to the PES protective lacquer imparts adhesive properties in a "B" staged or partially cured form. After applying the PES/epoxy to a PET film, a metallized polyolifin film or release (PMMA, PVOH, etc.) coated PET polyester film could be hot stamped at 350° to 500° F. (175° to 260° C.) with a heated silicone rubber pad. The metal would only transfer where its carrier film was contacted on the opposite side. The shape of the tranferred metal can therefore be controlled by the shape of the rubber pad. The adhesive tack imparted by the addition of the epoxy would permit spot transfer of the bright metal without dulling or turning the matte. Spot transfer may be accomplished before or after printing with graphic ink design followed by application of adhesive. The metal stays bright upon transfer of the composite to the substrate.

EXAMPLE #4

A thermosetting acrylic was mixed with an epoxy at an 85 to 15 parts ratio on a dry weight basic. After adjusting the viscosity with suitable solvents, this protective lacquer was printed on PET film and a high density polyethylene coated kraft carriers. Following the same ink, metallization and adhesive application sequence as in Example #1 produced the same transferred bright metal appearance. Application of a very thin release coating of PMMA or PVDF to the PET before the acrylic/epoxy thermosetting lacquer will permit easier release/transfer. These release layers are applied approximately ten times thinner than the protective lacquers.

We claim:

1. A method of transferring a design to an article comprising the steps of:

(a) coating a heat stable release coating onto a carrier sheet;

(b) coating an ink layer in a pattern on the heat stable release coating so that at least portions of the release coating remain uncovered with ink;

(c) applying a metallic layer over the release coating so that at least a portion of the metallic layer is in direct contact with and adheres directly to the release coating;

(d) applying a heat activatable adhesive layer over the metallic layer, said release layer, ink layer and metallic layer forming a transferable laminate, (e) transferring said transferable laminate from the carrier to an article at heat transfer temperatures in a range from 200° F. to 500° F., the transferred laminate on the article having a bright metallic appearance.

2. A method, as in claim 1, wherein the carrier comprises polyethyleneterephthalate.

3. A method as in claim 2 wherein the heat stable release coating comprises polymethylmethacrylate.

4. A method as in claim 1 wherein the release coating comprises polyvinyldifluoride.

5. A method as in claim 1 wherein the release coating comprises polyethersulfone.

6. A method as in claim 1 wherein the carrier comprises polyethylene and the release coating comprises polyethersulfone.

7. A method as in claim 1 wherein the carrier comprises polypropylene and the release coating comprises polyethersulfone.

8. A method of transferring a design to an article comprising the steps of:

(a) coating a heat stable release coating onto a carrier sheet, said carrier sheet comprising polyethylene terephthalate and said heat stable release coating comprising polyethersulfone;

(b) coating an ink layer in a pattern on the heat stable release coating so that at least portions of the release coating remain uncovered with ink;

(c) applying a metallic layer over the release coating so that at least a portion of the metallic layer is in direct contact with and adheres directly to the release coating;

(d) applying an etchant resistant coating over portions of said metallic layer so that other portions of the metallic layer remain exposed, said etchant resistant coating selected from the group consisting of polyethersulfone, polyamide lacquer and polyvinylchloride;

(e) applying an etchant coating in contact with said etchant resistant coating and said exposed metallic portions, said etchant coating removing said exposed metallic portions upon contact therewith;

(f) applying a heat activatable adhesive layer over the metallic layer, said release layer, ink layer and metallic layer forming a transferable laminate;

(g) transferring said transferable laminate from the carrier to an article at heat transfer temperatures in the range from 200° F. to 500° F., the transferred laminate on the article having a bright metallic appearance.

* * * * *